US010034102B2

(12) United States Patent
Zhang et al.

(10) Patent No.: US 10,034,102 B2
(45) **Date of Patent: *Jul. 24, 2018**

(54) METHODS AND APPARATUS FOR REDUCING AMBIENT NOISE BASED ON ANNOYANCE PERCEPTION AND MODELING FOR HEARING-IMPAIRED LISTENERS

(71) Applicant: Starkey Laboratories, Inc., Eden Prairie, MN (US)

(72) Inventors: Tao Zhang, Eden Prairie, MN (US); Martin McKinney, Minneapolis, MN (US); Jinjun Xiao, Chanhassen, MN (US); Srikanth Vishnubhotla, Waltham, MA (US); Buye Xu, Minnetonka, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 281 days.

This patent is subject to a terminal disclaimer.

(21) Appl. No.: 14/949,475

(22) Filed: Nov. 23, 2015

(65) Prior Publication Data

US 2016/0157029 A1 Jun. 2, 2016

Related U.S. Application Data

(63) Continuation of application No. 13/629,290, filed on Sep. 27, 2012, now Pat. No. 9,197,970.

(Continued)

(51) Int. Cl.

| | |
|---|---|
| ***H04R 25/00*** | (2006.01) |
| ***H04R 1/10*** | (2006.01) |
| ***G10K 11/178*** | (2006.01) |

(52) U.S. Cl.

CPC ..... *H04R 25/453* (2013.01); *G10K 11/178* (2013.01); *H04R 1/1083* (2013.01);

(Continued)

(58) Field of Classification Search

CPC ..... H04R 25/30; H04R 25/45; H04R 25/453; H04R 25/55; H04R 25/552; H04R 25/554;

(Continued)

(56) References Cited

U.S. PATENT DOCUMENTS 5,259,033 A * 11/1993 Goodings ..... H03H 21/0012 381/318
7,657,038 B2 * 2/2010 Doclo ..... G10L 21/0208 379/406.01

(Continued)

FOREIGN PATENT DOCUMENTS

EP 2284831 A1 2/2011
EP 2645362 A1 10/2013

OTHER PUBLICATIONS

"Application Serial No. 12837000.4, Response filed Nov. 21, 2016 to Extended European Search Report dated Apr. 21, 2016", 13 pgs.

(Continued)

*Primary Examiner* — Huyen D Le
(74) *Attorney, Agent, or Firm* — Schwegman Lundberg & Woessner, P.A.

(57) ABSTRACT

Disclosed herein, among other things, are apparatus and methods for annoyance perception and modeling for hearing-impaired listeners. One aspect of the present subject matter includes a method for improving noise cancellation for a wearer of a hearing assistance device having an adaptive filter. In various embodiments, the method includes calculating an annoyance measure or other perceptual measure based on a residual signal in an ear of the wearer, the (Continued)

wearer's hearing loss, and the wearer's preference. A spectral weighting function is estimated based on a ratio of the annoyance measure or other perceptual measure and spectral energy. The spectral weighting function is incorporated into a cost function for an update of the adaptive filter. The method includes minimizing the annoyance or other perceptual measure based cost function to achieve perceptually motivated adaptive noise cancellation, in various embodiments.

20 Claims, 2 Drawing Sheets

Related U.S. Application Data

(60) Provisional application No. 61/680,973, filed on Aug. 8, 2012, provisional application No. 61/539,783, filed on Sep. 27, 2011.

(52) U.S. Cl.
CPC ..... *H04R 25/45* (2013.01); *H04R 25/505* (2013.01); *H04R 25/554* (2013.01); *G10K 2210/1081* (2013.01); *G10K 2210/3012* (2013.01); *G10K 2210/3016* (2013.01); *G10K 2210/3028* (2013.01); *H04R 2225/021* (2013.01); *H04R 2225/023* (2013.01); *H04R 2225/025* (2013.01); *H04R 2225/41* (2013.01); *H04R 2460/01* (2013.01)

(58) Field of Classification Search
CPC ..... H04R 225/021; H04R 2225/025; H04R 2225/39; H04R 2225/41; H04R 2460/01
USPC ..... 381/60, 312, 314, 315, 317, 318, 320, 381/321, 71.1, 71.11, 71.12, 83, 93, 94.1, 381/94.2
See application file for complete search history.

(56) References Cited

U.S. PATENT DOCUMENTS 8,019,104 B2 * 9/2011 Klinkby ..... H04R 25/453 381/317
9,197,970 B2 * 11/2015 Zhang ..... H04R 25/45

OTHER PUBLICATIONS

"European Application Serial No. 12837000.4, European Office Action dated Feb. 9, 2017", 4 pgs.
"European Application Serial No. 12837000.4, Response filed Aug. 21, 2017 to Office Action dated Feb. 9, 2017", 8 pgs.
"European Application Serial No. 12837000.4, Extended European Search Report dated Apr. 21, 2016", 6 pgs.

* cited by examiner

METHODS AND APPARATUS FOR REDUCING AMBIENT NOISE BASED ON ANNOYANCE PERCEPTION AND MODELING FOR HEARING-IMPAIRED LISTENERS

CLAIM OF PRIORITY AND INCORPORATION BY REFERENCE

The is a continuation of U.S. patent application Ser. No. 13/629,290, filed on Sep. 27, 2012, now issued as U.S. Pat. No. 9,197,970, which claims the benefit under 35 § 119(e) of U.S. Provisional Patent Application 61/539,783, filed Sep. 27, 2011, and U.S. Provisional Patent Application 61/680,973, filed Aug. 8, 2012, the contents of which are incorporated herein by reference in their entirety.

TECHNICAL FIELD

This document relates generally to hearing assistance systems and more particularly to annoyance perception and modeling for hearing-impaired listeners and how to use these to reduce ambient noise in hearing assistance systems.

BACKGROUND

Hearing assistance devices are used to assist patient's suffering hearing loss by transmitting amplified sounds to ear canals. In one example, a hearing assistance device, or hearing instrument, is worn in and/or around a patient's ear. Traditional noise suppression or cancellation methods for hearing instruments are designed to reduce the ambient noise based on energy or other statistical criterion such as Wiener filtering. For hearing instruments, this may not be optimal because a hearing impaired (HI) listener is most concerned with noise perception instead of noise power or signal-to-noise ratio. In most noise suppression or cancellation algorithms, there is a tradeoff between noise suppression and speech distortion which is typically based on signal processing metrics instead of perceptual metrics. As a result, existing noise suppression or cancellation algorithms are not optimally designed for HI listeners' perception. Some noise suppression or cancellation algorithms adjust the relevant algorithm parameters based on listeners' feedback. However, they do not explicitly incorporate a perceptual metric into the algorithms.

Accordingly, there is a need in the art for improved noise cancellation for hearing assistance devices.

SUMMARY

Disclosed herein, among other things, are apparatus and methods for annoyance perception and modeling for hearing-impaired listeners and how to use these to reduce ambient noise in hearing assistance systems. One aspect of the present subject matter includes a method for improving noise cancellation for a wearer of a hearing assistance device having an adaptive filter. In various embodiments, the method includes calculating an annoyance measure based on a residual signal in an ear of the wearer, the wearer's hearing loss, and the wearer's preference. A spectral weighting function is estimated based on a ratio of the annoyance measure and spectral energy. The spectral weighting function is incorporated into a cost function for an update of the adaptive filter. The method includes minimizing the annoyance based cost function to achieve perceptually motivated adaptive noise cancellation, in various embodiments.

One aspect of the present subject matter includes a hearing assistance device including a housing and hearing assistance electronics within the housing. The hearing assistance electronics include an adaptive filter and are adapted to calculate an annoyance measure based on a residual signal in an ear of the wearer, the wearer's hearing loss, and the wearer's preference. The hearing assistance electronics are further adapted to estimate a spectral weighting function based on a ratio of the annoyance measure and spectral energy, and to incorporate the spectral weighting function into a cost function for an update of the adaptive filter, in various embodiments. Finally, the methods and apparatus described herein can be extended to use other perceptual metrics including, but not limited to, one or more of loudness, sharpness, roughness, pleasantness, fullness, and clarity.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

Figure 1:
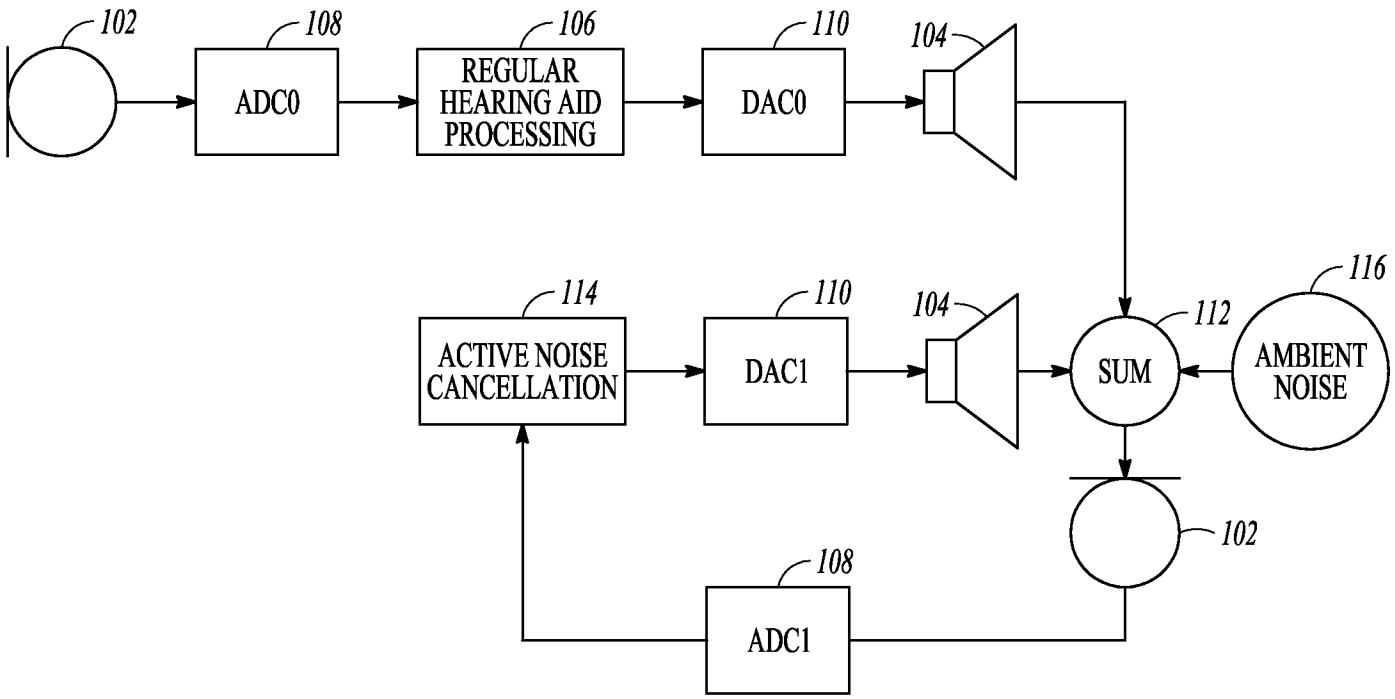
FIG. 1 illustrates a flow diagram showing active cancellation of ambient noise for a single hearing assistance device.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present detailed description will discuss hearing assistance devices using the example of hearing aids. Hearing aids are only one type of hearing assistance device. Other hearing assistance devices include, but are not limited to, those in this document. It is understood that their use in the description is intended to demonstrate the present subject matter, but not in a limited or exclusive or exhaustive sense.

Hearing aids typically include a housing or shell with internal components such as a microphone, electronics and a speaker. Traditional noise suppression or cancellation methods for hearing aids are designed to reduce the ambient noise based on energy or other statistical criterion such as Wiener filtering. For hearing aids, this may not be optimal because a hearing impaired (HI) listener is most concerned with noise perception instead of noise power or signal-to-noise ratio. In most noise suppression or cancellation algorithms, there is a tradeoff between noise suppression and speech distortion which is typically based on signal processing metrics instead of perceptual metrics. As a result, existing noise suppression or cancellation algorithms are not optimally designed for HI listeners' perception. Some noise suppression or cancellation algorithms adjust the relevant algorithm parameters based on listeners' feedback. However, they do not explicitly incorporate a perceptual metric into the algorithms.

Disclosed herein, among other things, are apparatus and methods for annoyance perception and modeling for hearing-impaired listeners and how to use these to reduce ambient noise in hearing assistance systems. One aspect of the present subject matter includes a method for improving noise cancellation for a wearer of a hearing assistance device having an adaptive filter. In various embodiments, the method includes calculating an annoyance measure based on a residual signal in an ear of the wearer, the wearer's hearing loss, and the wearer's preference. A spectral weighting function is estimated based on a ratio of the annoyance measure and spectral energy. The spectral weighting function is incorporated into a cost function for an update of the adaptive filter. The method includes minimizing the annoyance based cost function to achieve perceptually motivated adaptive noise cancellation, in various embodiments.

The present subject matter improves noise cancellation for a given HI listener by, among other things, improving processing based on an annoyance measure. In various embodiments the present subject matter performs hearing improvement using an approach approximated by the following:

a. calculating a specific annoyance measure based on a residual signal in the ear canal and a given HI listener's hearing loss and preference;
b. estimating a spectral weighting function based on a ratio of specific annoyance and spectral energy in run-time;
c. incorporating the spectral weighting into the cost function for adaptive filter update; and
d. achieving more effective noise cancellation by minimizing the overall annoyance.

In some embodiments, minimization does not take into account a minimization of energy. Other variations of this process are within the scope of the present subject matter. Some variations may include, but are not limited to, one or more of minimizing other perceptual measures such as loudness, sharpness, roughness, pleasantness, fullness, and clarity.

In various embodiments, the present subject matter creates a cost function that mathematically equals to the overall annoyance. In various embodiments, the annoyance estimation depends on the hearing loss, input noise and personal preference. In various embodiments, the annoyance based cost function is updated for each specific input noise in run-time statically by using a noise type classifier. In various embodiments, the annoyance based cost function is updated adaptively and the update rate may be slow or fast depending on the input noise. In various embodiments, the perceptually motivated adaptive noise cancellation is achieved by minimizing the annoyance based cost function.

In various embodiments by using an annoyance-based cost function, the algorithm is optimized to reduce the annoyance of a given noise instead of something indirectly related to the annoyance perception. In various embodiments, by calculating the annoyance-based cost function in run-time, the noise cancellation is fully optimized from the perceptual point of view. In various embodiments, by utilizing an annoyance cost function based on a HI listener's hearing loss and individual preference, the noise cancellation performance is also personalized.

One aspect of the present subject matter includes a hearing assistance device including a housing and hearing assistance electronics within the housing. The hearing assistance electronics include an adaptive filter and are adapted to calculate an annoyance measure based on a residual signal in an ear of the wearer, the wearer's hearing loss, and the wearer's preference. The hearing assistance electronics are further adapted to estimate a spectral weighting function based on a ratio of the annoyance measure and spectral energy, and to incorporate the spectral weighting function into a cost function for an update of the adaptive filter, in various embodiments.

FIG. 1 illustrates a flow diagram showing active cancellation of ambient noise for a single hearing assistance device. The system includes one or more inputs 102, such as microphones, and one or more outputs, such as speakers or receivers 104. The system also includes processing electronics 106, one or more analog-to-digital converters 108, one or more digital-to-analog converters 110, one or more summing components 112, and active noise cancellation 114 incorporating ambient noise 116.

Figure 2:
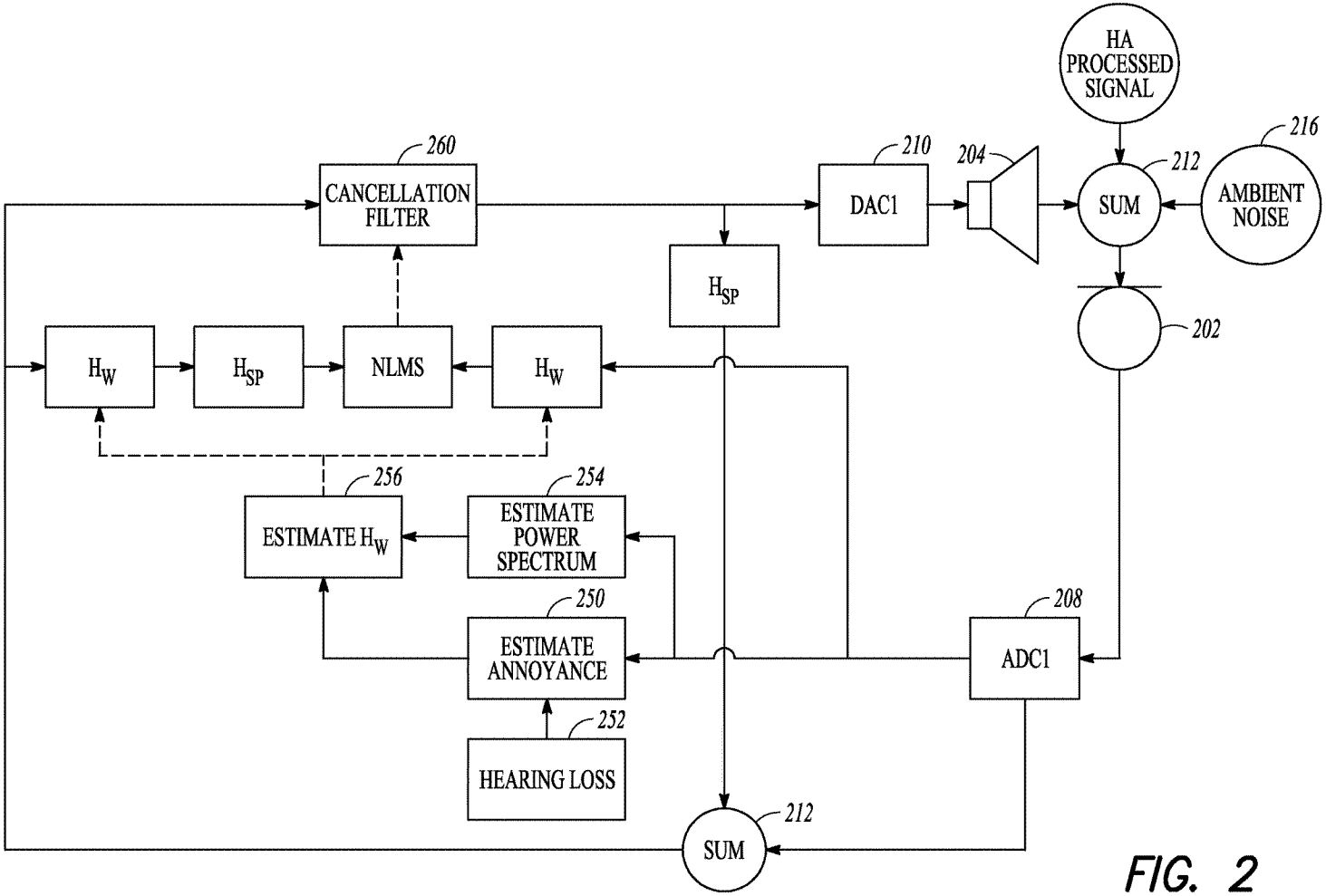
FIG. 2 illustrates a flow diagram showing perceptually motivated active noise cancellation for a hearing assistance device, according to various embodiments of the present subject matter.

FIG. 2 illustrates a flow diagram showing perceptually motivated active noise cancellation for a hearing assistance device, according to various embodiments of the present subject matter. The system includes one or more inputs 202, such as microphones, and one or more outputs, such as speakers or receivers 204. The system also includes processing electronics, one or more analog-to-digital converters 208, one or more digital-to-analog converters 210, one or more summing components 212, and active noise cancellation incorporating ambient noise 216. In various embodiments, the system includes estimating annoyance 250 using the listener's hearing loss 252. A spectral weighting function 256 is estimated based on a ratio of the annoyance measure 250 and spectral energy 254. The spectral weighting function 256 is incorporated into a cost function for an update of the adaptive filter 260, according to various embodiments.

In various embodiments, one goal of the noise cancellation algorithm is to minimize a weighted error as shown in the following equations:

$$H(k) = \underset{H(k)}{\text{Argmin}}\left[\sum_k W(k)E(k)\right]$$

where W(k) is the weighting function, E(k) is the residual noise signal power in the ear canal, and H(k) is the cancellation filter. If the weighting function is chosen as $$W(k) = \frac{A(k)}{E(k)}$$

where A(k) is the specific annoyance function, the overall annoyance is minimized as shown in the following equation:

$$H(k) = \underset{H(k)}{\text{Argmin}}\left[\sum_k \frac{A(k)E(k)}{E(k)}\right] = \underset{H(k)}{\text{Argmin}}\left[\sum_k A(k)\right]$$

Alternatively, the proposed subject matter can be implemented in audio devices or cell phone ear pieces for normal hearing listeners.

Some of the benefits of various embodiments of the present subject matter include but are not limited to one or more of the following. Some of the approaches set forth herein may significantly improve listening comfort in noisy environments. Some of the approaches set forth herein can provide a personalized solution for each individual listener.

In one embodiment, perceptual annoyance of environmental sounds was measured for normal-hearing and hearing-impaired listeners under iso-level and iso-loudness conditions. Data from the hearing-impaired listeners shows similar trends to that from normal-hearing subjects, but with greater variability. A regression model based on the statistics of specific loudness and other perceptual features is fit to the data from both subject types, in various embodiments.

The annoyance of sounds is an important topic in many fields, including urban design and development, transportation industries, environmental studies and hearing aid design. There exist established methods for subjective measurement of annoyance and data on annoyance has been collected in these various fields. The study of annoyance has been extended to include computational models that predict the annoyance of sounds based on their acoustic characteristics or through intermediate psychoacoustic models. While current models have limitations, they offer a cost-effective approach to estimating annoyance under a wide variety of conditions. This is helpful for those applications wherein iterative measures of annoyance are required to evaluate successive stages of system development. A significant limitation in our current understanding of annoyance and in our ability to model it is in the treatment of hearing-impaired (HI) listeners. Most previous research has dealt with normal-hearing (NH) listeners. However, an important application of annoyance assessment is in the development of hearing aid algorithms. It is well known that HI listeners have a low tolerance for high ambient noise. This becomes challenging with open fittings where ambient noise can propagate directly to the ear drum without going through hearing aids. Instead of minimizing the noise level it is more effective to minimize the annoyance. In order to do this effectively, there is a need to develop a better understanding of annoyance in HI listeners, and build computational models that reflect this understanding.

Data has been collected on the perceived annoyance of realistic environmental noise from both NH and HI listeners to characterize the difference in annoyance perception across the subject types. Low-frequency noises are relevant because they can be troublesome for HI listeners who wear open-fit hearing aids. The present subject matter includes a model for annoyance based on a loudness model that takes hearing impairment into account.

The test setup for the assessment of noise annoyance is described in this section. Eighteen subjects (12 NH and 6 HI) participated in one study. FIG. 1 shows the hearing loss profiles of those 5 HI subjects who were finally selected after the rating consistency check (refer to Sec. 3). The stimuli set consisted of eight everyday environmental noises. Each stimulus had a duration of 5 seconds and was taken from a longer recording. The stimuli were processed to produce 4 different conditions for each subject: two iso-loudness conditions (10 and 20 sones) and two iso-level conditions (NH subjects: 60 and 75 dB SPL; HI subjects: levels were chosen to match the average loudness of iso-level stimuli for NH subjects). Thus, a total of 32 stimuli were used for each subject. Two reference stimuli, namely pink noise at 60 and 75 dB SPL, were used for the NH subjects to compare the annoyance of the stimuli set with respect to the reference. For the HI subjects, the levels were again chosen to match the loudness of that of a NH subject. The purpose of using two reference stimuli in the test was to improve the rating consistency. It turns out that when the annoyance of the test stimulus is close to that of the reference stimuli, subjects are able to give annoyance ratings with higher consistency. The choice of iso-loudness and iso-sound pressure levels was motivated by the desire to understand the effect of level and loudness on the annoyance experienced by both NH and HI subjects. Stimuli included an airplane noise, bathroom fan, car, diesel engine, hair dryer, motorcycle, vacuum cleaner and clothes washer.

The stimuli were played through a headset unilaterally in a sound treated room. In front of a computer screen, the subjects rate the annoyance of the test stimuli relative to each of the 2 reference stimuli. Each subject was asked to listen to one reference and a test stimulus at least once during each trial. The annoyance of each test stimulus is rated relative to that of the reference. If the test stimulus is twice as annoying as the reference, a rating of 2 is given. If the test stimulus is half as annoying as the reference, a rating of 0.5 is given. The study had a duration of about 60 minutes. A Training trial was used to acclimatize the subjects with the 34 stimuli (32 test stimuli and 2 reference stimuli). A Testing trial then involved 102 ratings, wherein the subject rated each stimulus according to its annoyance level relative to that of the reference stimulus. Part of the test trial was used for the subject to get acquainted with the rating task, and part of the test trial was used to check the consistency of the subject on the task. Eventually 64 rating ratings (among the total of 102), 32 ratings for each of the 2 references, were used in the final analysis and modeling.

To obtain a unique annoyance rating for each stimulus, the 2 ratings (against two references) were combined with certain weights. The resultant rating is the (perceptual) average relative annoyance of the stimulus. This average rating was then mapped into the logarithmic domain, which helps in the modeling and prediction stage because the transformed annoyance ratings were distributed more evenly along the number line, in various embodiments. The last 18 ratings in the testing trial were repetitions of earlier trials and were used to check the rating consistency of each subject. The correlation coefficient r between the first and replicated ratings of the 18 stimuli was calculated for each subject. Among the 18 subjects, 14 subjects (9 NH and 5 HI) produced high r values $>0.7$. The average correlation among these 12 subjects is 0.86. Four subjects had correlations $r<0.7$ and were deemed unreliable. The data from these four subjects was excluded from further analyses.

The annoyance ratings reported by the subjects for the iso-loudness case (i.e., when all stimuli are of the same loudness), the annoyance still varies across stimuli—the acoustic features proposed in this study are aimed at capturing the factors which explain this difference. Importantly, greater loudness causes subjects to report increased annoyance. Similar observations can be drawn from the iso-level stimuli. Finally, the patterns of annoyance reported by different HI subjects differ from each other, which is a consequence of their hearing loss profiles.

Annoyance ratings as a function of some of the proposed features for a NH subject and 2 HI subjects was determined, for the 2 iso-loudness cases combined across all stimuli. For each iso-loudness case, the annoyance is in the similar range for both NH and HI subjects. This is expected since in the iso-loudness case, the stimuli have been scaled to match each other in loudness—thus resulting in similar annoyance. Another observation is that for each of the features, annoyance varies roughly linearly with the feature value. For example, increasing specific loudness causes higher annoyance for both NH and HI subjects. Similarly, increased Q-Factor causes more annoyance—an indicator of the effect of stimulus sharpness.

In various embodiments, a preliminary linear regression model is used for the annoyance perceived by NH subjects, and it is used as a baseline to analyze the annoyance perception of HI subjects. The model uses psycho-acoustically motivated features to model psycho-acoustic annoyance. The feature set includes: $\{N_i, F_{mod}, V_{mod}, Q, F_{res}\}$, where

- $N_i$: $1 \le i \le 24$ is the Average Channel Specific Loudness feature on the 24 critical bands, calculated by temporally averaging the specific loudness profile [12].
- The Maximum Modulation Rate ($F_{mod}$) and Modulation Peak Value ($V_{mod}$) describe the rate and degree respectively of the spectro-temporal variations, and captures the roughness of a stimulus.
- The Resonant Frequency $F_{res}$ is defined as the frequency with the maximum average channel specific loudness. The Q-Factor is defined as the ratio of the Resonant Frequency to the bandwidth of the stimulus. The above two feature are used to capture the sharpness of a stimulus.

However, due to the high dimensionality of the feature vector and limited amount of annoyance data, it is preferable to reduce the number of features before modeling. First we reduced the dimensionality in $N_i$: $1 \le i \le 24$. Analysis of the spectral properties of the stimuli suggests that we can combine the specific loudness $N_i$ into two bands: (1) Band 1 through 8, and (2) Band 9 through 24. Roughly speaking the 24 specific loudness features are compressed into 2 features: Average Specific Loudness for f below 1000 Hz, $N_{<1000}$, and Average Specific Loudness for f above 1000 Hz, $N_{>1000}$.

Next, sequential variable selection was performed to identify the final set of features. The selection procedure started with two features for regression, $N_{<1000}$ and $N_{>1000}$. All other features were sequentially added as explanatory variables. The extra-sum-of-squares F-statistic was calculated for each added feature, and the one with the largest F-statistic value was kept in the model. This procedure was repeated until no further addition significantly improves the fit. This feature selection process yielded the following feature set: $\{N_{<1000}, N_{>1000}, Q, F_{res}\}$. The features $F_{mod}$ and $V_{mod}$ were eliminated by the selection process—this might have been due to the distribution of this feature across stimuli in the dataset. Since the majority of stimuli in this test contained little modulation, the extracted modulation features were not statistically significant for the task of annoyance modeling.

A Linear Regression model was used as a predictor for annoyance, in an embodiment. The set of annoyance ratings for NH subjects were taken as the target data to be predicted, and the set of weights for the 5 acoustic features were estimated using the standard regression fitting process, including outlier detection. The following expression was obtained for the annoyance rating A of NH subjects in terms of the features $N_{<1000}$, $N_{>1000}$, $F_{mod}$, Q and $F_{res}$:

$$A=0.37+3.20N_{<1000}+5.19N_{>1000}+0.97Q+1.51F_{res}$$

The weights obtained for each feature in the model follow the general understanding of annoyance. In particular, an increase in the specific loudness in either frequency region (below and above 1000 Hz) predicts an increase in the annoyance rating. A larger weight for $N_{>1000}$ than that for $N_{<1000}$ implies greater annoyance sensitivity to the specific loudness in the high frequency region. As the Q-factor and the resonant frequency are related to sharpness, the annoyance is expected to increase with them, which is consistent with the estimated positive weights for these features.

Comparing the predictions of the model with real NH data, it was found that the model prediction fits the average of the real annoyance ratings very well for each stimulus, implying that this regression model has likely captured the most significant factors contributing to the average annoyance perception of NH subjects (for the stimuli set used in this study). The $R^2$ statistic for this iso-level case is [13] is 0.98, even though the weights were estimated using data from the four iso-loudness and iso-level stimuli.

Since the NH annoyance model was based on features extracted from perceptual loudness, the same model can potentially be applied to the HI data. In fact, the NH annoyance model does capture the general trend of the HI subjects' annoyance ratings fairly well but the accuracy varies with subjects. For HI subjects A, B, and D, the NH model predicts their annoyance ratings reasonably well. A comparison between the model prediction and Subject B's annoyance ratings is shown in 4 as an example—the $R^2$ statistic for this subject is 0.77. For HI subjects C and E, the accuracy of the model predictions was notably worse.

Due to the limitations of this study, no effort was made to obtain a linear regression model based on the annoyance ratings of all the HI subjects as one set. Instead, attempts were made to obtain a linear regression model (using the same features as being used in the NH model) for each HI subject. Each individual model would only be applicable to that subject. However, two general trends are worth mentioning. First, unlike the NH model, the weight for $N_{>1000}$ tends to be smaller than the weight for $N_{<1000}$ in the case of HI subjects, which could be a consequence of the hearing loss at the high frequencies for most subjects. Secondly, the weights for the Q factor and the resonant frequency tend to be greater than those in the NH model.

The annoyance data of both NH and HI subjects showed a strong dependency on overall loudness. The range of annoyance ratings for HI subjects was larger than that for NH subjects. A linear regression model incorporated with the specific loudness as well as other features was derived based on the annoyance ratings of the NH subjects. This applied the NH model directly to the annoyance ratings of the HI subjects. While the proposed model can account for the data from some HI subjects, it fails to accurately predict annoyance data for all HI subjects.

The goal of noise reduction in hearing aids is to improve listening perception. Existing noise reduction algorithms are typically based on engineering or quasi-perceptual cost functions. The present subject matter includes a perceptually motivated noise reduction algorithm that incorporates an annoyance model into the cost function. Annoyance perception differs for HI and NH listeners. HI listeners are less consistent at rating annoyance than NH listeners, HI listeners show a greater range of annoyance ratings, and differences in annoyance ratings between NH and HI listeners are stimulus dependent.

Loudness is a significant factor of annoyance perception in HI listeners. There was no significant effect found for sharpness, fluctuation strength and roughness, even though these factors have been used in annoyance models for NH listeners.

The present subject matter provides perceptually motivated active noise cancellation (ANC) for HI listeners through loudness minimization, in various embodiments. A cost function includes overall loudness of error residue, based on a specific loudness, and achieved through spectrum shaping on the NLMS update. Similar formulations can be extended to other metrics, including, but not limited to, one or more of sharpness, roughness, clarity, fullness, pleasantness or other metrics in various embodiments. A simulation comparing energy-based ANC and annoyance-based ANC showed improved loudness reduction for all configurations, although improvements depend on HL degree and slope.

Any hearing assistance device may be used without departing from the scope and the devices depicted in the figures are intended to demonstrate the subject matter, but not in a limited, exhaustive, or exclusive sense. It is also understood that the present subject matter can be used with a device designed for use in the right ear or the left ear or both ears of the wearer.

It is understood that the hearing aids referenced in this patent application include a processor. The processor may be a digital signal processor (DSP), microprocessor, microcontroller, or other digital logic. The processing of signals referenced in this application can be performed using the processor. Processing may be done in the digital domain, the analog domain, or combinations thereof. Processing may be done using subband processing techniques. Processing may be done with frequency domain or time domain approaches. For simplicity, in some examples blocks used to perform frequency synthesis, frequency analysis, analog-to-digital conversion, amplification, and certain types of filtering and processing may be omitted for brevity. In various embodiments the processor is adapted to perform instructions stored in memory which may or may not be explicitly shown. In various embodiments, instructions are performed by the processor to perform a number of signal processing tasks. In such embodiments, analog components are in communication with the processor to perform signal tasks, such as microphone reception, or receiver sound embodiments (i.e., in applications where such transducers are used). In various embodiments, realizations of the block diagrams, circuits, and processes set forth herein may occur without departing from the scope of the present subject matter.

The present subject matter can be used for a variety of hearing assistance devices, including but not limited to, cochlear implant type hearing devices, hearing aids, such as behind-the-ear (BTE), in-the-ear (ITE), in-the-canal (ITC), completely-in-the-canal (CIC), or invisible-in-the canal (IIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user. Such devices are also known as receiver-in-the-canal (RIC) or receiver-in-the-ear (RITE) hearing instruments. It is understood that other hearing assistance devices not expressly stated herein may fall within the scope of the present subject matter.

The methods illustrated in this disclosure are not intended to be exclusive of other methods within the scope of the present subject matter. Those of ordinary skill in the art will understand, upon reading and comprehending this disclosure, other methods within the scope of the present subject matter. The above-identified embodiments, and portions of the illustrated embodiments, are not necessarily mutually exclusive.

The above detailed description is intended to be illustrative, and not restrictive. Other embodiments will be apparent to those of skill in the art upon reading and understanding the above description. The scope of the invention should, therefore, be determined with reference to the appended claims, along with the full scope of equivalents to which such claims are entitled.

What is claimed is:

1. A method for improving noise cancellation for a wearer of a hearing assistance device having an adaptive filter, the method comprising:

calculating an annoyance measure based on a residual signal in an ear of the wearer, the wearer's hearing loss, and the wearer's preference;

estimating a weighting function based on the annoyance measure and properties of the residual signal; and incorporating the weighting function into a cost function for an update of the adaptive filter.

2. The method of claim 1, further comprising minimizing the annoyance based cost function to achieve perceptually motivated adaptive noise cancellation.

3. The method of claim 1, comprising updating the cost function based on input noise.

4. The method of claim 3, wherein updating the cost function includes updating the cost function during runtime.

5. The method of claim 3, wherein updating the cost function includes using a noise type classifier.

6. The method of claim 3, wherein updating the cost function includes updating the cost function adaptively.

7. The method of claim 3, wherein updating the cost function includes using an update rate which depends upon the input noise.

8. The method of claim 1, comprising using the cost function to minimize loudness.

9. The method of claim 8, comprising using the cost function to minimize overall loudness of error residue.

10. The method of claim 8, comprising using the cost function to minimize specific loudness.

11. A hearing assistance device for a wearer, comprising:

a housing; and hearing assistance electronics within the housing;

wherein the hearing assistance electronics include an adaptive filter and are adapted to:

calculate an annoyance measurement based on a residual signal in an ear of the wearer, the wearer's hearing loss, and the wearer's preference;

estimate a weighting function based on the annoyance measurement and properties of the residual signal; and incorporate the weighting function into a cost function for an update of the adaptive filter.

12. The device of claim 11, wherein the hearing assistance electronics include a wireless communication unit.

13. The device of claim 12; wherein the hearing assistance electronics use the wireless communication unit to synchronize the perceptually motivated adaptation between the left and right hearing devices.

14. The device of claim 12; wherein the hearing assistance electronics use the wireless communication unit to obtain the wearer's preference from other wireless devices.

15. The device of claim 11, wherein the housing includes an in-the-ear (ITE) hearing aid housing.

16. The device of claim 11, wherein the housing includes a behind-the-ear (BTE) housing.

17. The device of claim 11, wherein the housing includes an in-the-canal (ITC) housing.

18. The device of claim 11, rein the housing includes a receiver-in-canal (RIC) housing.

19. The device of claim 11, wherein the housing includes a completely-in-the-canal (CIC) housing.

20. The device of claim 11, wherein the housing includes a receiver-in-the-ear (RITE) housing.

* * * * *